US006956454B1

(12) United States Patent
Garcia et al.

(10) Patent No.: US 6,956,454 B1
(45) Date of Patent: Oct. 18, 2005

(54) MAGNETIC SUBASSEMBLY OF AN ELECTRICAL BREAKER APPARATUS

(75) Inventors: José Garcia, Agey (FR); Patrick Larcher, Ahuy (FR); Arnaud Rivals, Dijon (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 11/091,769

(22) Filed: Mar. 29, 2005

(30) Foreign Application Priority Data

Apr. 1, 2004 (FR) ..... 04 03460

(51) Int. Cl.[7] ..... H01F 3/00; H01F 7/08

(52) U.S. Cl. ..... 335/281; 335/279

(58) Field of Search ..... 335/6, 9, 10, 21–46, 335/172–176, 255–264, 270, 278, 279–281

(56) References Cited

FOREIGN PATENT DOCUMENTS

| | | |
|---|---|---|
| DE | 25 31 215 A1 | 2/1977 |
| EP | 0 515 292 A1 | 5/1992 |
| WO | WO 99/63564 | 12/1999 |

*Primary Examiner*—Ramon M. Barrera
(74) *Attorney, Agent, or Firm*—Oblon, Spivak, McClelland, Maier & Neustadt, P.C.

(57) ABSTRACT

Magnetic subassembly for electrical breaker apparatus, comprising a magnetic yoke (10), a fixed core (39) and a moveable core (30) sliding along an axis (X) inside an insulating sheath (20) under the action of an induction coil (25) arranged around the sheath (20). The moveable coil (30) possesses a radial annulus (33) separating a first part (31) and a second part (32) of different radial section, the magnetic yoke (10) comprises a radial face (11) perpendicular to the axis (X) with an opening (19) centred on the axis (X) and traversed by the first part (31) of the moveable core (30). The opening (19) comprises a fluted perimeter composed of a plurality (N) of teeth (17) directed towards the axis (X), hollow zones (15) situated between each tooth (17) accommodating an end of the insulating sheath (20).

8 Claims, 2 Drawing Sheets

MAGNETIC SUBASSEMBLY OF AN ELECTRICAL BREAKER APPARATUS

Figure 1:
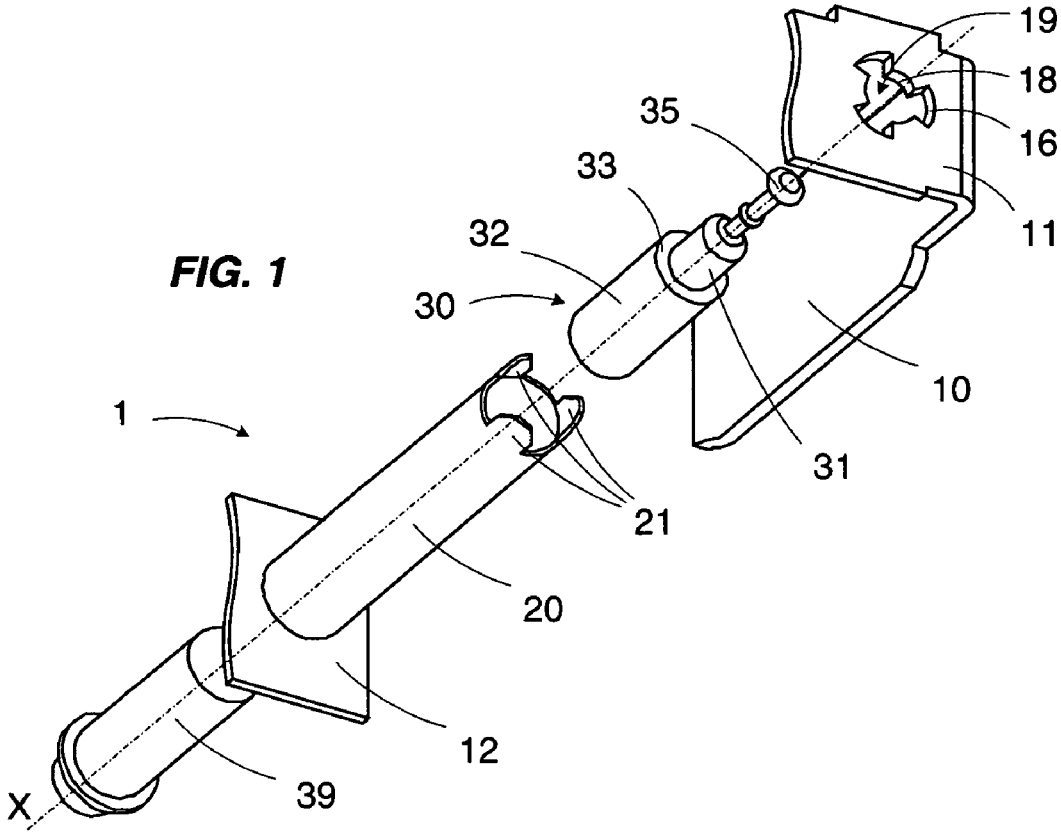

The present invention pertains to a low voltage electrical breaker apparatus, of the isolator or contactor/isolator type, useable in particular for the monitoring and/or the control of an electric load such as a motor. More particularly, the invention pertains to a magnetic protection subassembly of such a breaker apparatus intended to protect the electric load in the event of the circulation of a high current.

The magnetic protection subassemblies used in electrical apparatuses of this kind are well known devices, described in particular in documents FR2779567, EP0501844. They are responsible for rapidly and abruptly opening the electrical contacts of a breaker apparatus in the event of an electrical overload, typically when the current rises beyond a predetermined magnetic tripping threshold, for example thirteen times the nominal current. For this purpose, they comprise an electromagnet, sometimes called a striker, through whose coil the current to be monitored flows. The moveable core of the striker stores up energy as the ampere turns increase in the coil and then, when the current exceeds the tripping threshold, liberates this energy suddenly, so as to be capable of efficiently and rapidly separating the moveable contacts from the fixed contacts of the apparatus.

The drawback of the existing devices is that the level of the magnetic tripping threshold is generally difficult to adjust and to reproduce from one apparatus to another, while the value of this threshold is obviously significant in order for it to be possible for the apparatus to guarantee the safety of goods and people. To obtain a reliable and reproducible tripping threshold, the manufacturing tolerances must be reduced so as to preserve great dimensional accuracy and zones of magnetic sticking between fixed and moveable elements, requiring possible truing, thereby penalizing the manufacture and the cost of such subassemblies. In certain apparatuses, slender gap insulating shims have to be added. In these devices it is also difficult to correctly centre the moveable core throughout its travel, without implementing sophisticated guidance to minimize clearances.

An aim of the invention is to find a simple and economical solution which makes it possible on the one hand to efficiently guide the moveable core of the striker so as to ensure correct sliding thereof throughout its travel while retaining its accurate positioning with respect to the fixed elements, such as the yoke of the striker.

An aim of the invention is also the possibility of easily adjusting the magnetic tripping threshold for a given rating while dispensing with the disparities in the dimensions of the various components and without requiring the addition of extra elements, such as gap rings in particular. The solution also avoids the need to complicate the manufacture of the components, in particular the shape of the moveable core.

This is why the invention discloses a magnetic subassembly for electrical breaker apparatus, comprising a magnetic circuit consisting of a yoke, of a fixed core and of a moveable core sliding along a longitudinal axis X inside an insulating sheath between a tripped position and a rest position under the action of an induction coil arranged around the sheath. The moveable coil possesses a radial annulus separating a first part and a second part of different radial section. The yoke comprises a radial face substantially perpendicular to the axis X with an opening centred on the axis X and traversed by the first part of the moveable core. The said opening comprises a fluted perimeter composed of a plurality of teeth directed towards the axis X, hollow zones situated between each tooth accommodating an end of the insulating sheath.

According to a characteristic, the superposition between the radial annulus of the moveable core and the teeth of the opening forms, in the rest position, a radial magnetic zone allowing the circulation of an axial magnetic flux. Moreover, a fixed radial gap exists between a front edge of each tooth and the first part of the moveable core, allowing the circulation of a radial magnetic flux. According to another characteristic, the end of the sheath comprises a plurality of axial protuberances held by wedging in the hollow zones of the opening.

The invention also describes an electrical breaker apparatus fitted with at least one moveable contact cooperating with at least one fixed contact, and comprising such a magnetic subassembly acting on the moveable contact or contacts.

Figure 2:
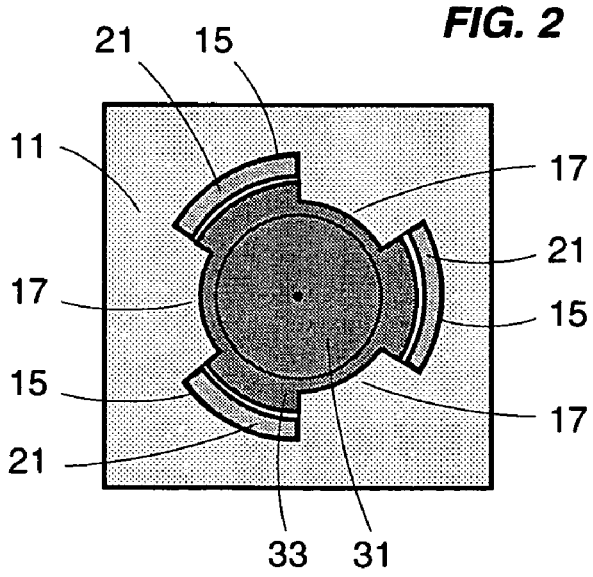
Figure 3:
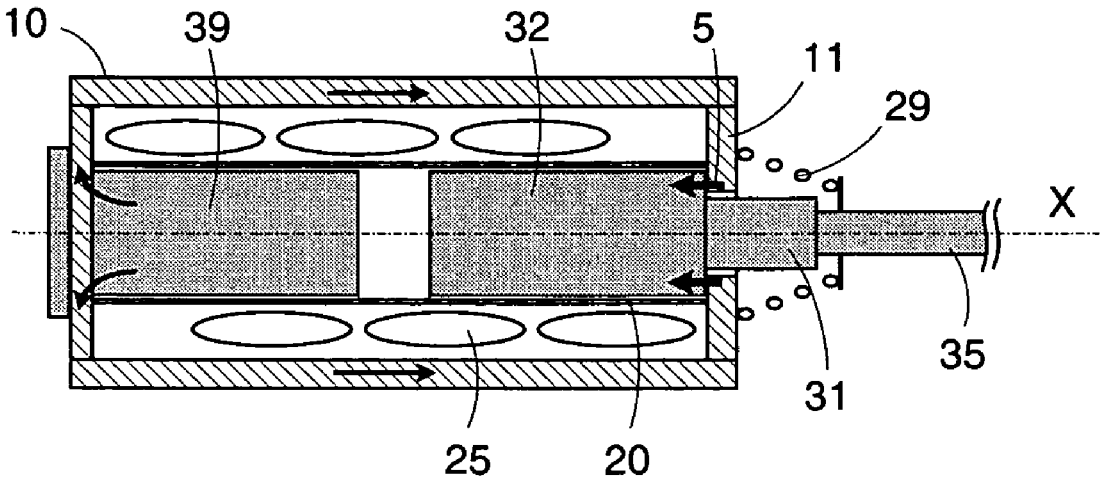
Figure 4:
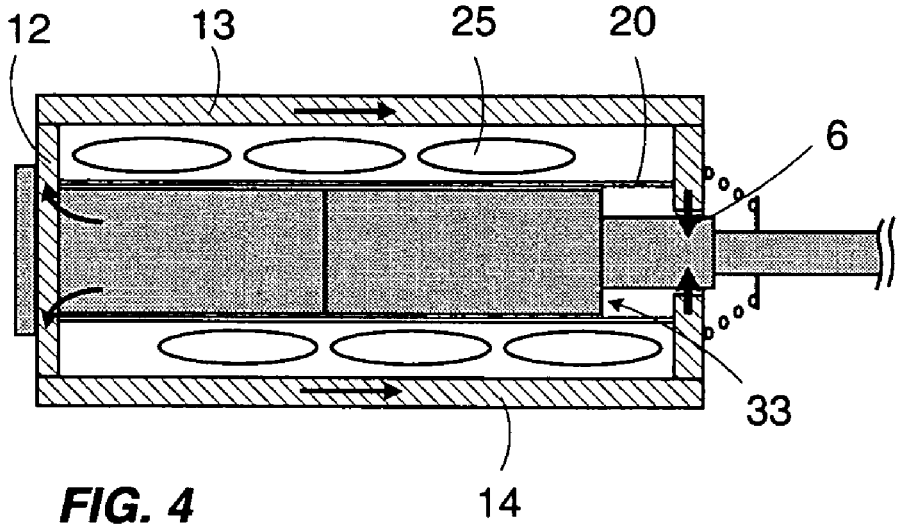

Other characteristics and advantages will become apparent in the detailed description which follows while referring to an embodiment given by way of example and represented by the appended drawings in which:

FIG. 1 represents a perspective exploded view of a magnetic subassembly in accordance with the invention, FIG. 2 details a simplified end-on view showing the opening in the radial face of the magnetic yoke, FIGS. 3 and 4 diagrammatically show in a simplified manner an example of a subassembly in an axial (or longitudinal) view, respectively in the rest position and in the tripped position.

With reference to FIGS. 1, 3 and 4, a magnetic subassembly 1 is intended to monitor a power current circulating around a breaker apparatus and to trip abruptly when this current exceeds a certain threshold, called the tripping threshold. The magnetic subassembly 1 comprises a magnetic circuit composed of a magnetic yoke 10, of a fixed core 39 and of a moveable core 30 which are made from a ferromagnetic material.

The fixed core 39 and the moveable core 30 are aligned along a longitudinal axis X and are surrounded by an insulating cylindrical sheath 20. The moveable core 30 slides inside this insulating sheath 20 along the longitudinal axis X between a rest position, shown diagrammatically in FIG. 3, and a tripped position, shown diagrammatically in FIG. 4. The moveable core 30 displaces under the action of an induction coil 25 arranged around the insulating sheath 20, but not represented in FIG. 1. When the intensity of the current to be monitored circulating around the coil 25 exceeds the tripping threshold, the moveable core then displaces rapidly from the rest position to the tripped position. In the event that the current in the coil 25 disappears, a restoring member, such as a restoring spring 29, returns the moveable core 30 to its rest position. The moveable core is composed of a first part 31 and of a second part 32 juxtaposed in the direction of the fixed core 39.

In the preferred embodiment, the first and second parts 31, 32 are cylindrical and the diameter of the second part 32 is adjusted so as to be able to just slide inside the cylindrical sheath 20 without creating any clearance. The first and second cylindrical parts 31, 32 possess a different radial section, in this instance the diameter of the part 31 is less than that of the part 32. The diameter of the second part 32 is substantially equal to that of the fixed core 39. The parts 31 and 32 are therefore separated by a rim from the part 32 which thus forms a radial annulus 33. In a manner which is known in this type of subassembly, the moveable core 30 also comprises a striker member 35, for example extending directly in line with the first part 31, which is responsible for transmitting the motion of the moveable core to the moveable contact(s) of the breaker apparatus, so as to separate it (them) from the corresponding fixed contact(s), when the moveable core 30 passes to the tripped position.

The magnetic yoke 10, partially represented in FIG. 1, forms a substantially rectangular frame surrounding the coil 25 and the sheath 20, composed of two longitudinal planes 13, 14 substantially parallel to the axis X, surrounded by two radial faces 11, 12 substantially perpendicular to the axis X. The fixed core 39 is fixed to one of the radial faces 12. The other radial face 11 possesses a radial opening 19 centred on the axis X and traversed by the first part 31 of the moveable core. The diameter of the second part 32 of the moveable core is on the other hand big enough to prevent it from passing through the opening 19.

The manner of operation of a magnetic subassembly of magnetic striker type is as follows. In the absence of current in the coil 25, the moveable core 30 is held by the small restoring spring 29 in the rest position (see FIG. 3), thereby keeping it apart from the fixed core 39. In this position, the radial annulus 33 is hard up against the radial face 11 of the yoke 10, thus creating a radial magnetic sticking zone. When a current begins to circulate around the coil 25, a magnetic field is created passing from the fixed core 39 to the yoke 12, 13, 14, 11 and then passing preferentially from the radial face 11 directly to the annulus 33 in the axial direction, as represented by the arrows 5 of FIG. 3. Specifically, in the rest position, the axial gap existing between the radial face 11 and the annulus 33 is less than the fixed radial gap between the radial face 11 and the circumference of the first part 31 of the moveable core 30. The moveable core 30 therefore undergoes a force of attraction towards the fixed core 39 but also an opposite retaining force directed towards the radial face 11 of the magnetic yoke. As long as the current to be monitored remains small, the retaining force is predominant and the moveable core 30 remains substantially immobile, the axial gap still being less than the radial gap.

As the ampere turns created by the coil 25 go on increasing, the radial magnetic sticking zone will become saturated and the force of attraction will then increase more quickly than the retaining force. A growing axial gap will appear at this location, at the moment at which the moveable core 30 commences its motion in the direction of the fixed core 39 (this corresponding to an instantaneous current in the coil that is greater than the defined tripping threshold). The magnetic field will then preferentially circulate from the radial face 11 to the first part 31 of the moveable core 30 in the radial direction, as represented by the arrows 6 of FIG. 4. The retaining force will then abruptly tend to zero and the moveable coil will be driven very rapidly by the force of attraction so as to strike the fixed core 39, practically without resistance other than that of the restoring spring 39 with a very small resisting force.

According to the invention, the radial opening 19 comprises a fluted interior perimeter consisting of a plurality N of teeth 17 directed towards the axis X, distributed around this perimeter and surrounded by a plurality N of hollow zones 15 situated between each tooth 17 (see FIGS. 1 and 2). The teeth 17 are dimensioned in such a way that the first part 31 of the moveable core 30 can pass freely through the opening 19 in the interior space situated between the teeth 17, but so that the teeth 17 can on the other hand retain the second part 32. When the moveable core 30 is in the rest position, the radial annulus 33 is therefore hard up against the teeth 17, thus creating a very small axial gap.

The radial magnetic sticking zone, created by the superposition of the radial annulus 33 with the teeth 17, allows the circulation of an axial magnetic flux 5. This radial magnetic zone is discontinuous on account of the fluted perimeter of the opening 19, thereby avoiding the need to have an excessively big retaining force applied to the moveable core 30 by the axial magnetic flux 5. This discontinuity will moreover make it possible to adjust the retaining force very simply. In particular, merely by tailoring the width of the teeth 17, it is then possible to modify the radial magnetic zone area and hence to easily alter the tripping threshold of the subassembly 1, without modifying other dimensions or characteristics, in particular without it being necessary to modify and complicate the shape of the moveable core with bores or grooves on the radial annulus 33, which would incur extra costs in the manufacture of such a component. Moreover, this avoids the need to have to add high-precision additional rings or shims to increase the axial gap between the radial annulus 33 and the teeth 17.

The teeth 17 each exhibit a front edge 18 directed towards the axis X and whose shape is preferably complementary to the perimeter of the first part 31 of the moveable core 30, which is in this instance a circular arc shape. For the proper operation of the subassembly 1, the radial gaps existing between the front edge 18 of the various teeth 17 and the perimeter of the first part 31 must remain constant. Moreover, the axial motion of the moveable core 30 should not be disturbed by wedging or the like, so that the striker member 35 acts effectively. The centring of the moveable core 30 throughout its travel along the axis X is therefore crucial. It is ensured by virtue of the guiding of the insulating sheath 20 which snugly surrounds the second part 32 of the moveable core 30. However, this centring is difficult since it necessitates the firm securing of the two ends of the insulating sheath 20 with respect to the magnetic yoke 10.

A first end of the insulating sheath 20 is easily fixed to the radial face 12. According to the invention, the other opposite end of the insulating sheath 20 is advantageously fluted by virtue of a plurality of N protuberances 21 which extend the insulating sheath in an axial direction X. These protuberances 21 will engage in the N hollow zones 15 situated between the teeth 17 and will be held therein for example by simple wedging. Each hollow zone 15 comprises a rear wall 16 directed towards the axis X. The hollow zones 15 are dimensioned such that the protuberances 21 are thus hard up against the rear walls 16, preventing any radial motion of the sheath 20. This simple device makes it possible to hold the insulating sheath perfectly centred with respect to the axis X and therefore to avoid the variations in the radial gap and to ensure proper sliding of the moveable core 30. It is then easier to guarantee good reproducibility and proper reliability of the performance of the magnetic subassembly 1.

According to the embodiment presented, the number N of teeth 17 and of hollow zones 15 is equal to three. The three hollow zones 15 cooperate with three protuberances 21 of the sheath 20. The teeth 17 are regularly distributed about the axis X and of equal width, so as to balance the radial forces due to the radial magnetic flux 16 passing through the radial gaps and therefore to maintain the centring of the first part 31 of the moveable core 30 inside the opening 19.

A number N different from three could also be envisaged, such as for example an opening 19 comprising two teeth 17 symmetrically opposite with respect to the axis X and two protuberances 21 likewise symmetric with the end of the sheath 20, as suggested by FIGS. 3 and 4. In another variant, it would also be possible to have several teeth of different widths associated with a positioning not regularly distributed about the axis X, so as nevertheless to ensure proper balancing of the magnetic radial forces on the moveable core.

Moreover, the preferred embodiment describes a magnetic subassembly whose insulating sheath, fixed core and moveable core all possess circular radial sections. Other solutions for these elements could also be envisaged, such as for example radial sections of substantially square shape. They would then be associated with an opening 19 likewise of a suitable square shape, exhibiting a fluted perimeter of four teeth (one on each side of the square) on which would bear the square radial annulus of the moveable core, the four teeth being surrounded by four hollow zones (in each corner of the square) cooperating with four corresponding projections at the end of the insulating sheath.

Naturally, other variants and refinements of detail can be contemplated, without departing from the framework of the invention, and the employing of equivalent means may also be envisaged.

What is claimed is:

1. Magnetic subassembly for electrical breaker apparatus, comprising a magnetic circuit consisting of a yoke (10), of a fixed core (39) and of a moveable core (30) sliding along a longitudinal axis (X) inside an insulating sheath (20) between a tripped position and a rest position under the action of an induction coil (25) arranged around the sheath (20), the moveable core (30) possessing a radial annulus (33) separating a first part (31) and a second part (32) of different radial section, the yoke (10) comprising a radial face (11) substantially perpendicular to the axis (X) with an opening (19) centered on the axis (X) and traversed by the first part (31) of the moveable core (30), characterized in that the said opening (19) comprises a fluted perimeter composed of a plurality (N) of teeth (17) directed towards the axis (X), hollow zones (15) situated between each tooth (17) accommodating an end of the insulating sheath (20).

2. Magnetic subassembly according to claim 1, characterized in that the superposition between the radial annulus (33) of the moveable core (30) and the teeth (17) of the opening (19) forms, in the rest position, a radial magnetic zone allowing the circulation of an axial magnetic flux (5).

3. Magnetic subassembly according to claim 2, characterized in that a fixed radial gap exists between a front edge (18) of each tooth (17) and the first part (31) of the moveable core (30), allowing the circulation of a radial magnetic flux (6).

4. Magnetic subassembly according to claim 1, characterized in that the end of the sheath (20) comprises a plurality (N) of axial protuberances held by wedging in the hollow zones (15) of the opening (19).

5. Magnetic subassembly according to claim 1, characterized in that the teeth (17) of the opening (19) have a substantially identical width.

6. Magnetic subassembly according to claim 1, characterized in that the sheath (20), the fixed core (39) and the moveable core (30) possess circular radial sections.

7. Magnetic subassembly according to claim 6, characterized in that the opening (19) comprises three teeth (17) regularly distributed about the axis (X) and the end of the sheath (20) comprises three protuberances (21) engaged in the hollow zones (15).

8. Electrical breaker apparatus fitted with at least one moveable contact cooperating with at least one fixed contact, characterized in that it comprises a magnetic subassembly (1) according to one of the preceding claims acting on the moveable contact or contacts.

* * * * *